US005163570A

United States Patent [19]

Mundis et al.

[11] Patent Number: 5,163,570

[45] Date of Patent: Nov. 17, 1992

[54] LOAD SENSING DEVICE FOR A BOOM MOUNTED ON A VEHICLE

[75] Inventors: James W. Mundis; Harold M. Ball, both of Broken Arrow, Okla.

[73] Assignee: Paccar Inc., Bellevue, Wash.

[21] Appl. No.: 707,154

[22] Filed: May 28, 1991

[51] Int. Cl.[5] ..... E02F 5/02

[52] U.S. Cl. ..... 212/155; 212/247

[58] Field of Search ..... 212/150, 154, 155, 247, 212/240, 245; 414/687, 694, 742

[56] References Cited

U.S. PATENT DOCUMENTS

| | | | |
|---|---|---|---|
| 647,239 | 4/1900 | Sprague . | |
| 1,490,671 | 4/1924 | Lindstrom et al. . | |
| 2,300,343 | 10/1942 | Clay . | |
| 3,079,080 | 2/1963 | Mason | 212/155 |
| 4,013,174 | 3/1977 | Morrow et al. | 212/245 |
| 4,093,091 | 6/1978 | Gregg et al. | 212/155 |
| 4,456,093 | 6/1984 | Finley et al. | 212/155 |
| 4,596,508 | 6/1986 | Kishi et al. | 212/247 |
| 4,625,946 | 12/1986 | Clark, Jr. et al. | 254/274 |

FOREIGN PATENT DOCUMENTS 950003 2/1964 United Kingdom .

*Primary Examiner*—Joseph F. Peters, Jr.
*Assistant Examiner*—Stephen P. Avila
*Attorney, Agent, or Firm*—Seed and Berry

[57] ABSTRACT

The present invention comprises a hydraulic sensing means to be used in connection with a worm/worm wheel gear arrangement for articulating a boom mounted on a vehicle. A hydraulic chamber on each side of the worm is formed by a bearing retainer and a piston. A worm thrust in the direction of either hydraulic chamber increases the fluid pressure in that particular chamber, which causes the fluid pressure in a closed hydraulic circuit to increase. The pressure increase is sensed by a fluid pressure gauge which sends a signal and/or terminates input power to the worm if the increase in fluid pressure is above a predetermined pressure.

10 Claims, 3 Drawing Sheets

LOAD SENSING DEVICE FOR A BOOM MOUNTED ON A VEHICLE

DESCRIPTION

1. Technical Field

This invention pertains to load sensing devices, and more particularly, to sensing devices used to detect an overload condition on a gear used to rotate an upper structure mounted on a vehicle.

2. Background of the Invention

The problems associated with cranes and other types of lifting devices mounted on vehicles have long been recognized. In particular, problems associated with overloading by swinging the boom to the sides of the vehicle and in pulling articles with the boom can result in failure of the boom. Failure of the boom may occur when the boom is made of a lightweight, nonconducting material, such as fiberglass. Typical situations in which an overload on the boom may occur are when the vehicle is on sloped terrain while the boom is being articulated, when the boom being articulated strikes an object to the side of the vehicle, and when the boom, extended to the side of the vehicle, is used to pull a load, either by forward movement of the vehicle or by continued articulation of the boom. Once the boom has been overloaded, the operator typically does not have sufficient time to shutoff power to the lifting device or to the gear that rotates the boom to prevent the dangerous condition.

Lifting devices that include a mechanical means for shutting off the power to the lifting device and/or sending a signal to the operator in the event of an emergency are known. U.S. Pat. Nos. 4,625,946 and 2,300,343 and Great Britain Patent No. 950,003 disclose mechanical devices for terminating or limiting input power provided to the gear driving the lifting device in the event of an overload situation. These prior mechanical safety features used in connection with a worm/worm wheel gear arrangement are deficient for several reasons. First, such mechanical safety devices occupy a significant portion of space within the gear box or outside of the gear box. Second, such mechanical sensing devices are prone to malfunction and wear out quickly, thus requiring a lot of maintenance and repair work. Third, such mechanical safety devices are complex and difficult to assemble, and thus expensive to manufacture. Finally, the mechanical sensing devices must typically convert the mechanical safety signal into a hydraulic signal to terminate or limit hydraulic input power supplied to the worm.

SUMMARY OF THE INVENTION

It is an object of the present invention to provide a sensing means that will readily detect an overload of force on the worm of a worm/worm wheel gear arrangement resulting from an overload condition on a boom mounted on a vehicle.

Another object of the present invention is to provide a sensing device that is compact and requires little space inside the gear box.

Still another object of the present invention is to provide a closed hydraulic circuit for precisely and accurately sensing an overload on a worm of a worm/worm wheel gear arrangement.

Another object of the present invention is to provide a hydraulic sensing means for determining an overload condition on a worm of a worm/worm wheel gear arrangement so that the hydraulic sensor can be tied directly into a hydraulic drive means to shutoff hydraulic force supplied to the drive in the event of an overload condition.

Still another object of the present invention is to provide a hydraulic overload sensor that senses an overload of force to the worm resulting from the boom being articulated to either side of the vehicle.

The foregoing objects are achieved by providing a hydraulic sensing means for use in connection with a gearbox containing a worm/worm wheel gear arrangement. A hydraulic circuit is formed by providing a hydraulic chamber on each side of the worm. The hydraulic chamber is defined on one side by a bearing retainer coupled to the gear housing and on a second end by a piston disposed around the shaft of the worm. Movement of the worm causes the piston to likewise move which increases the hydraulic pressure in the hydraulic chamber. A pressure gauge in the hydraulic circuit senses the pressure increase and sends a warning signal to the operator and/or terminates the input power to the worm.

Each piston abuts a shoulder of the gear housing in a direction toward the middle of the gear box to prevent inward movement of the piston. The abutment by the piston with the shoulder ensures that only the piston on the side of the overload responds to an outward thrust force on the worm to compress the hydraulic fluid inside the hydraulic chamber. Since the sensing of the thrust of the worm is unidirectional for each hydraulic chamber, accurate sensing of an overload on the boom of either side of the vehicle is possible.

DETAILED DESCRIPTION OF THE INVENTION

Figure 1:
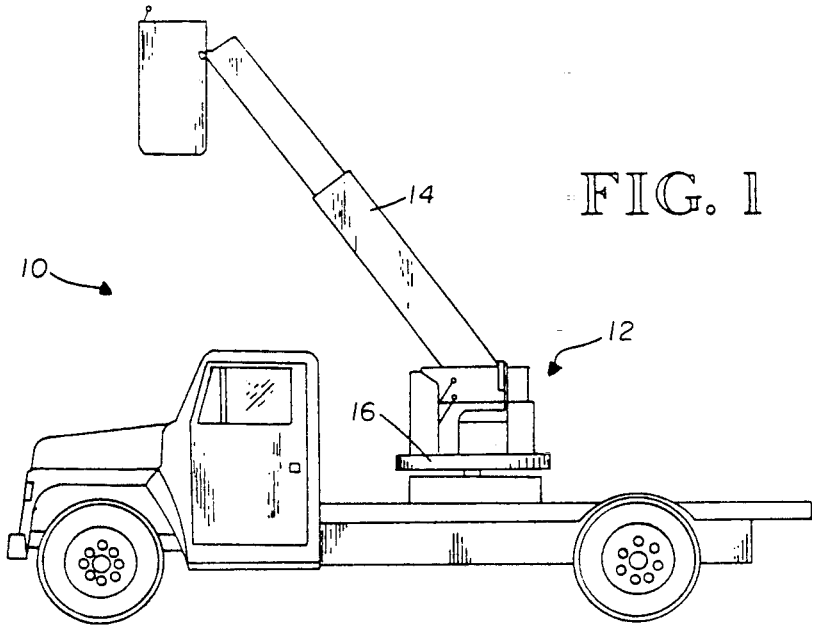
FIG. 1 is a side elevational view of a vehicle having a typical lifting device system in which the present invention is utilized.

With reference to FIG. 1, the present invention relates generally to a hydraulic sensing device for sensing an overload condition on the gear means that rotates an upper structure or a boom 14 mounted on vehicle 10 for hoisting or lifting some type load. A lifting device 12, including the boom, is mounted on a turret 16 which rotates the lifting device and boom relative to the vehicle to position the boom at a desired location about the vehicle. The utility truck shown in FIG. 1 is a so-called cherry picker, but it is understood that the present invention could be used in any type of crane or utility vehicle that includes a boom.

Figure 2:
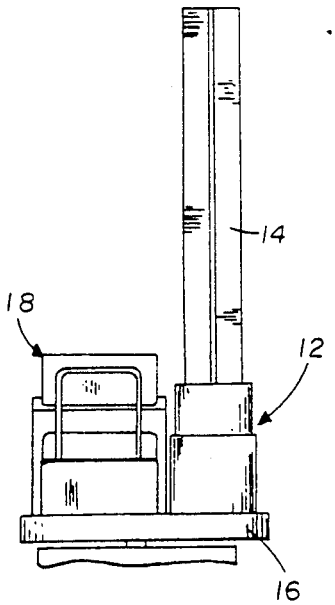
FIG. 2 is a rear view of the lifting device system of FIG. 1 in which the present invention is utilized.

Referring to FIG. 2, the lifting device 12 and associated boom 14 are mounted to the turret 16, which in turn is rotatably mounted to the vehicle. An operator's chair 18 is also mounted on top of the turret so that the operator is able to constantly monitor the position of the boom. It should be understood that the invention could be used with a lifting device, associated boom, and operator's chair being mounted in a variety of ways, including the presence of some, but not all, components mounted on the turret, and when the components are mounted separately from one another.

Figure 3:
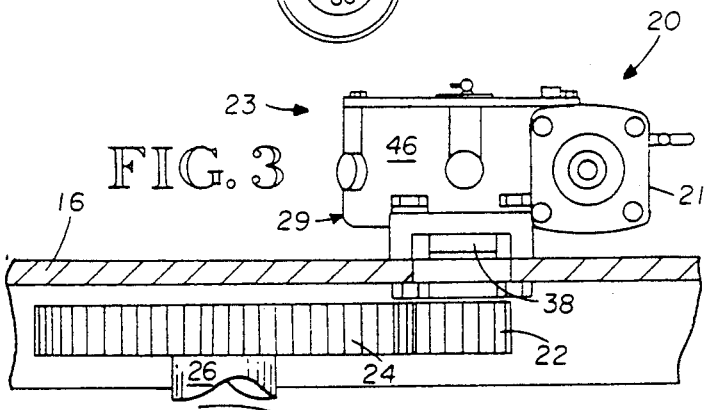
FIG. 3 is a side elevational view, partly in section, of the drive means and gear means in which the present invention is utilized.

FIG. 3 shows a drive means 20 mounted to the top surface of the turret 16. The drive means includes a motor 21 for supplying input power to the gear means 23. The gear means includes a gear housing 46 within which is mounted a worm/worm wheel gear arrangement (not shown). A shaft 38 extends from the center of the gear box 29 and ends in a pinion gear 22 which extends below the top surface of the turret 16. The pinion gear operatively engages a circular rack 24 rigidly connected to the vehicle 10 by shaft 26 such that when a rotational force is supplied by the pinion gear to the rack, the turret rotates relative to the vehicle.

Figure 4:
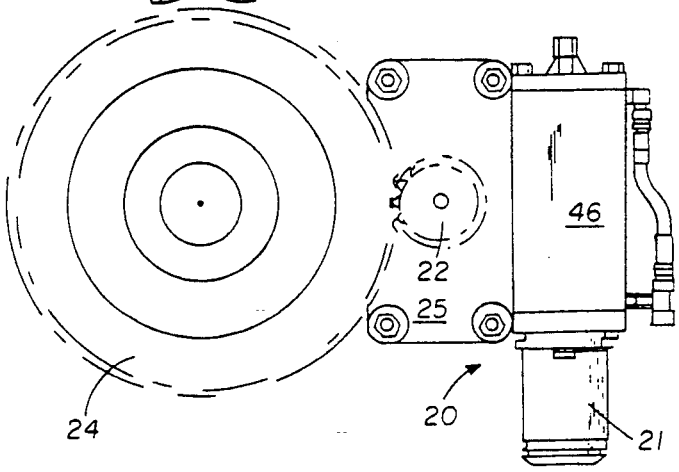
FIG. 4 is a bottom view of the drive means and gear means of FIG. 3 in which the present invention is utilized.

FIG. 4 shows a bottom view of the pinion gear 22 engaging the rack 24. The pinion gear extends below the plate 25 which is mounted to the top of the turret 16.

Figure 5:
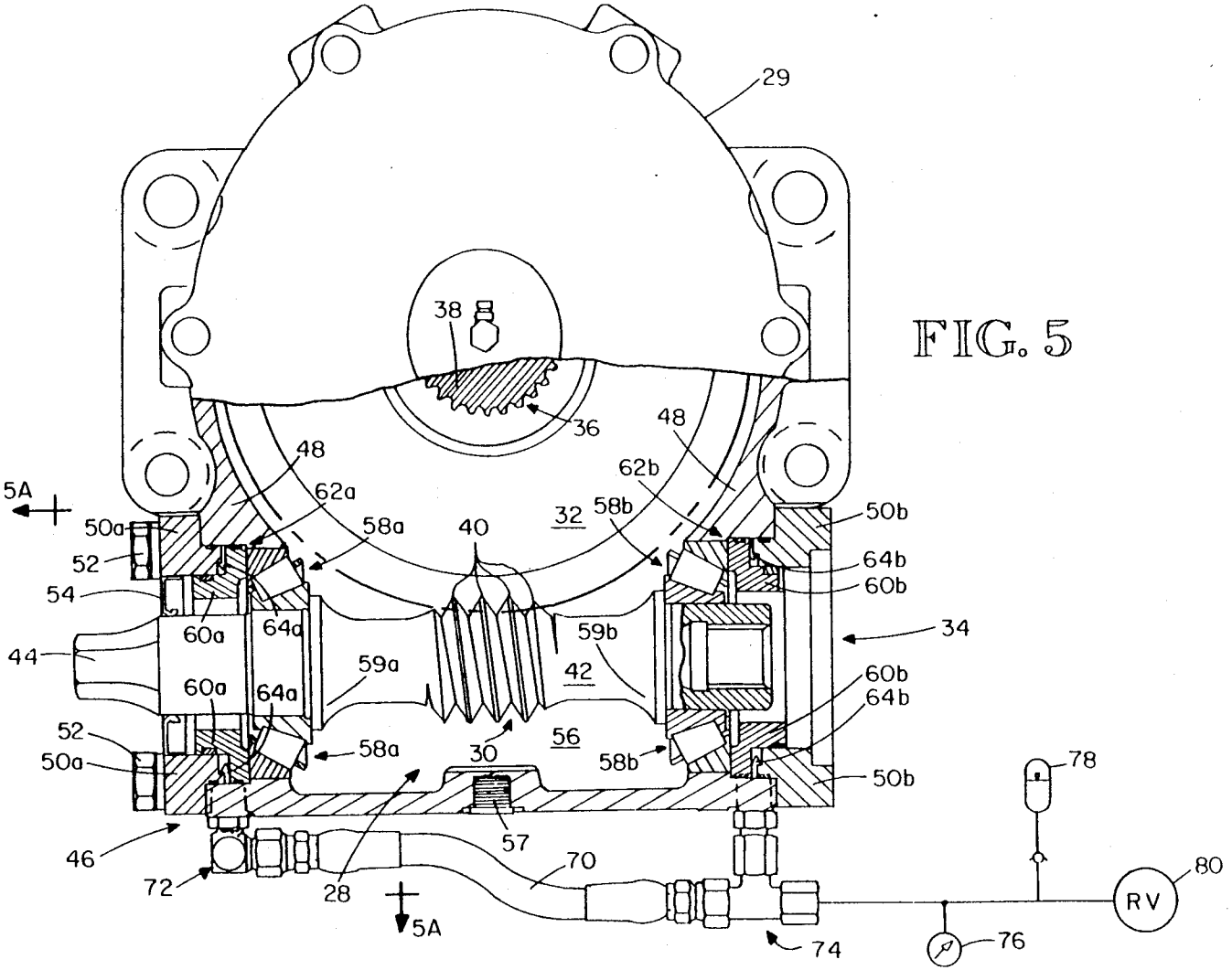
FIG. 5 is a top view, partly in section, of a worm/worm wheel gear arrangement including the present invention.

Referring now to FIG. 5, a preferred embodiment of the present invention includes a worm/worm wheel gear arrangement 28 mounted in a gear box 29. The worm/worm wheel gear arrangement comprises a worm 30 having multiple teeth 40 which mesh with multiple teeth (not shown) of a worm wheel 32. It is to be understood that the worm may have only a single helical tooth as opposed to multiple teeth. This worm-/worm wheel gear arrangement is conventional and well known by those skilled in the art. A shaft of a conventional hydraulic or electric motor (not shown) engages a spline connection 33 at one end of the worm to provide an input, rotational force 34 to the worm which, in turn, rotates the worm wheel 32. The worm wheel includes a spline connection 36 for receiving a drive shaft 38 which terminates in the pinion gear 22 (shown in FIG. 3).

The worm 30 further includes a shaft 42 which terminates at one end in a hexagonal-shaped end 44 which extends beyond the gear housing 46. The hexagonal end may be used to manually turn the worm in case of failure of the input power 34.

The gear box 29 includes a gear housing 46 within which the worm/worm wheel gear arrangement 28 is mounted. The gear housing 46 comprises a main housing portion 48 which provides the main structure for rotatably supporting the worm/worm wheel gear arrangement. The worm shaft 42 is secured in place at each end by bearing retainers 50*a*, 50*b* which are rigidly secured to the main housing portion by a plurality of bolts 52. The mounting bolts for the bearing retainer 50*b* are not shown because the motor through which the bolts are inserted is also not shown. An oil seal 54 seals the gear box and prevents oil from the oil reservoir 56 from escaping. The oil level in the oil reservoir can be checked by removing the threaded plug 57.

The worm shaft 42 is rotatably supported within the gear housing 46 by a pair of conventional tapered roller bearings 58*a*, 58*b* which allow the worm shaft to rotate freely within the gear housing. The tapered roller bearings engage opposite flaired portions 59*a*, 59*b* of the worm shaft 42 to ensure that no transverse movement of the worm 30 occurs during non-loaded conditions.

A pair of pistons 60*a*, 60*b* is located between each tapered roller bearing 58*a*, 58*b* and the bearing retainers 50*a*, 50*b*. Under normal conditions, each piston abuts shoulder portions 62*a*, 62*b* of the main housing portion 48. The pistons 60*a*, 60*b* and the bearing retainer 50*a*, 50*b* define a pair of hydraulic fluid chambers 64*a*, 64*b*.

Figure 5A:
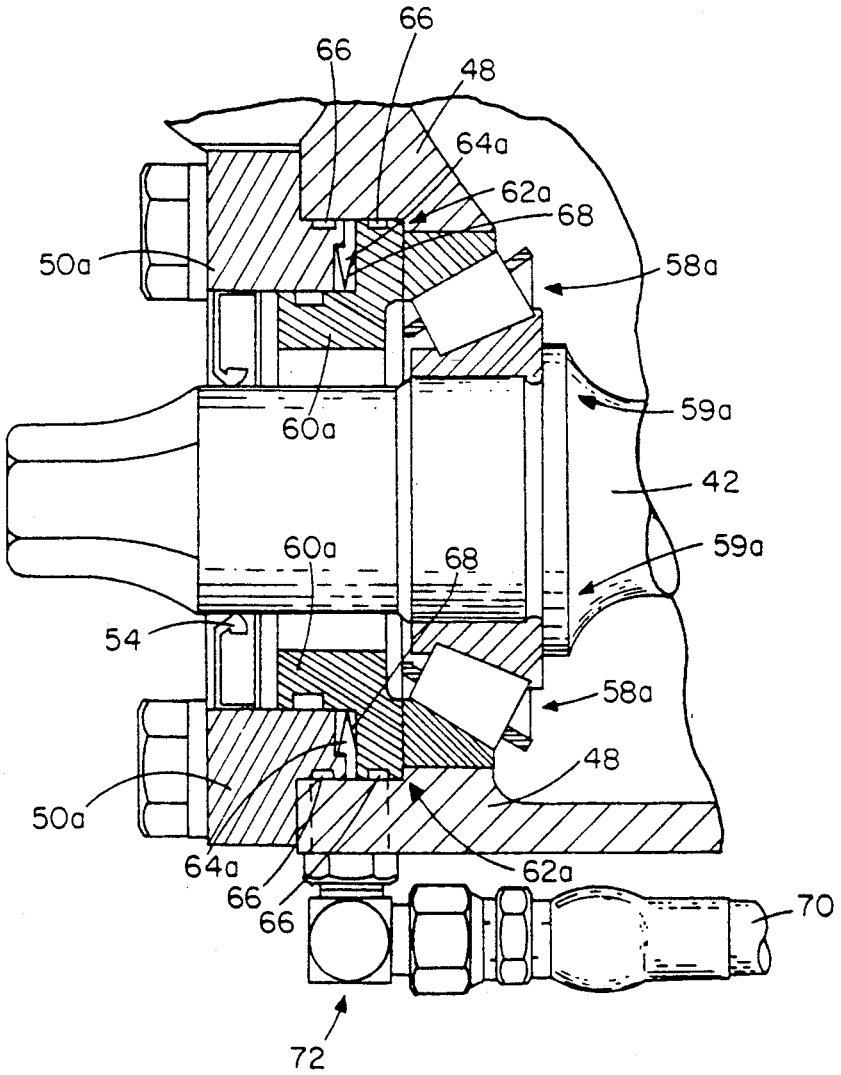
FIG. 5A is an enlarged view of the area shown as 5A in FIG. 5, which depicts aspects of the present invention in greater detail.

With reference to FIG. 5A, showing a more detailed view of the features surrounding the hydraulic chamber 64, a hydraulic fluid chamber 64*a* is located at an end of the worm shaft 42 to create a sealed hydraulic circuit for sensing a thrust force exerted on the worm. A pair or O-rings 66 are located in between the bearing retainer 50*a* and the main housing portion 48, and the piston 60*a* and the main housing portion, respectively. A more detailed view of the features of the hydraulic chamber is shown in FIG. 5A. Inside the hydraulic fluid chamber is a wave spring 68 which is required for proper initial alignment and installation of the worm 30 within the gear housing 46, but serves no purpose after initial installation.

When a thrust force is exerted on the worm 30, the worm shaft 42 is forced outward (to the left in FIG. 5A) which causes the flaired portion 59*a* to engage the roller bearing 58*a*. If a sufficient thrust force is exerted on the worm, the roller bearing will, in turn, force the piston 60*a* toward the bearing retainer 50*a* which increases fluid pressure in hydraulic chamber 64*a*. Since the opposite piston 60*b* (shown in FIG. 5) is prevented from moving inward because of the abutment with the shoulder 62, an increase in hydraulic pressure in either chamber 64*a* or chamber 64*b* results in an increase in pressure in the entire hydraulic circuit.

As previously stated, the hydraulic circuit of the present invention is a closed system which comprises two hydraulic chambers 64*a*, 64*b* located on each end of the worm 30, the chambers being fluidly interconnected by a flexible hose 70, an L-shaped coupling 72, and a T-shaped coupling 74. One end of the T-shaped coupling is fluidly connected to a hydraulic pressure gauge 76 which senses a change in the hydraulic pressure in the closed hydraulic circuit. If the pressure in the circuit reaches a predetermined level, the pressure gauge can be arranged to send a signal to the operator that an overload situation is imminent. Alternatively, the pressure gauge sends a hydraulic fluid signal that directly acts to terminate input power supplied by the motor to the worm. This will immediately stop articulation of the boom and prevent an overload from occurring. The hydraulic pressure switch could alternatively convert the increase in hydraulic pressure into an electric signal to terminate electric power to an electric motor supplying input power to the worm 30.

The hydraulic circuit also comprises an accumulator 78 to ensure a constant, minimum hydraulic pressure to the circuit. A thermal relief valve 80 is located at one end of the hydraulic circuit to relieve any increase in hydraulic pressure in the circuit caused by factors other than thrust force on the worm, such as heat from the sun.

As mentioned above, a unique aspect of the present invention is that the fluid pressure in the hydraulic circuit 71 is affected only by an increase in fluid pressure in one of the hydraulic chambers 64*a* or 64*b*, and that movement of these pistons is unidirectional. For example, when the boom is rotated to extend on the left hand side of the worm/worm wheel arrangement shown in FIG. 5, an overload situation would create a thrust on the worm 30 toward the right side of the gear box 29 (i.e., in a direction transverse to the normal rotational direction of the worm). This would cause the pressure within fluid chamber 64*b* to increase and, upon reaching a predetermined level, would cause the fluid pressure switch 76 to send a warning signal of the potential overload and/or send a signal to shutoff power to the worm. The hydraulic pressure in chamber 64*b* increases because the volume of the chamber decreases. At the same time, however, the volume of chamber 64*a* remains unchanged because the piston 66 abuts the shoulder 62 of the main housing portion 48 to prevent movement of the piston 66*a* in the direction toward the right side of the gear box. An overload as a result of the boom being extended on the right hand side of the worm/worm wheel arrangement 28 shown in FIG. 5 would similarly create a thrust on the worm 30 in a direction toward the left hand side of the gear box 29 which would increase fluid pressure in chamber 64*a* by decreasing the volume of chamber 64*a*, but the volume in chamber 64*b* would remain unchanged because of the abutment with shoulder 62*b*.

While various embodiments of the invention have been illustrated and described, it is to be understood that various other embodiments will be apparent to one of ordinary skill in the art. Accordingly, the invention is not to be limited to the embodiments illustrated in the drawings.

We claim:

1. A load sensing device for sensing a load on a boom mounted to a vehicle, comprising:

a boom operatively coupled to a vehicle;

gear means for rotating the boom relative to the vehicle;

a gear housing mounted to the vehicle for containing the gear means, the gear housing defining a hydraulic chamber forming part of a hydraulic circuit, the hydraulic chamber being in fluid communication with the gear means such that a thrust force exerted on the gear means from the boom increases the hydraulic pressure in the hydraulic chamber; and a hydraulic pressure gauge in fluid communication with the hydraulic chamber for measuring hydraulic pressure changes in the hydraulic chamber and for sending a warning signal of an overload condition on the gear means when the pressure in the hydraulic circuit reaches a predetermined pressure.

2. The load sensing device of claim 1, further comprising:

a hydraulic switch fluidly connected to the hydraulic pressure gauge for terminating power input to the gear means when the overload condition is sensed.

3. The load sensing device of claim 1, further comprising:

an electric switch operatively connected to the hydraulic pressure gauge for terminating power input to the gear means when the overload condition is sensed.

4. A load sensing device for sensing a load on a boom mounted to a vehicle, comprising:

a boom operatively coupled to a vehicle;

gear means for rotating the boom relative to the vehicle;

a gear housing mounted to the vehicle for containing the gear means, the gear housing defining a hydraulic chamber forming part of a hydraulic circuit, the hydraulic chamber being in fluid communication with the gear means such that a thrust force exerted on the gear means from the boom increases the hydraulic pressure in the hydraulic chamber;

a hydraulic pressure gauge in fluid communication with the hydraulic chamber for measuring hydraulic pressure changes in the hydraulic chamber and for sending a warning signal of an overload condition on the gear means when the pressure in the hydraulic circuit reaches a predetermined pressure; and wherein the hydraulic chamber is defined on one side by a bearing retainer coupled a main portion of the gear housing and on a second side by a piston disposed around a shaft of the gear means such that movement of the shaft in a direction transverse to the normal rotational direction of the shaft resulting from a load on the boom causes like movement of the piston which increases hydraulic pressure in the hydraulic chamber, the pressure increase being sensed by the hydraulic pressure gauge.

5. The load sensing device according to claim 4 wherein the housing includes a shoulder for engaging the piston to prevent transverse inward movement of the piston so that hydraulic pressure in the hydraulic chamber changes only upon outward transverse movement of the piston.

6. A load sensing device for sensing a load on a boom mounted to a vehicle, comprising:

a boom operatively coupled to a vehicle;

gear means for rotating the boom relative to the vehicle;

a gear housing mounted to the vehicle for containing the gear means, the gear housing defining a hydraulic chamber forming part of a hydraulic circuit, the hydraulic chamber being in fluid communication with the gear means such that a thrust force exerted on the gear means from the boom increases the hydraulic pressure in the hydraulic chamber;

a hydraulic pressure gauge in fluid communication with the hydraulic chamber for measuring hydraulic pressure changes in the hydraulic chamber and for sending a warning signal of an overload condition on the gear means when the pressure in the hydraulic circuit reaches a predetermined pressure; and wherein the gear means comprises:

a worm rotatably mounted in the gear housing, the worm being driven by a motor, the gear housing and motor being secured to a turret rotatably mounted on a vehicle;

a worm wheel operatively connected to the worm to form a worm/worm wheel drive arrangement such that rotation of the worm causes the worm wheel to rotate, the worm wheel having a shaft extending outwardly of a center axis of the worm wheel, said shaft terminating in a pinion gear at an end opposite the worm wheel; and a circular rack operatively connected to the pinion gear and rigidly secured to the vehicle such that providing input power to the worm, and thus the worm wheel, pinion gear, and rack, respectively, causes the turret to rotate relative to the vehicle and articulate the boom.

7. The load sensing device according to claim 6 wherein the hydraulic chamber is defined on one side by a bearing retainer coupled a main portion of the gear housing and on a second side by a piston disposed around a shaft of the worm such that movement of the worm in a direction transverse to the normal rotational direction of the worm due to a load being placed on the boom causes the piston to move which increases hydraulic pressure in the hydraulic chamber, the increase in hydraulic pressure being sensed by the hydraulic pressure gauge to signal an overload condition on the boom.

8. A load sensing device for a worm/worm wheel drive for detecting an overload condition on the worm, comprising:

a gear housing;

a worm rotatably mounted in said gear housing, said worm being adapted to be rotated by a drive means;

a worm wheel operatively coupled to said worm to form a worm/worm wheel drive arrangement such that rotation of said worm causes said worm wheel to rotate, said worm wheel having a shaft extending outwardly of said a center axis of said worm wheel, said shaft terminating in a pinion gear at an opposite end relative to said worm wheel;

a rack operatively coupled to said pinion gear such that said rack moves as said pinion gear rotates;

said gear housing defining a hydraulic chamber adapted to hold hydraulic fluid, said hydraulic chamber forming part of a hydraulic circuit, said hydraulic chamber communicating with said worm such that a thrust force exerted on said worm increases pressure of said hydraulic fluid in said hydraulic chamber;

measuring means in fluid communication with said hydraulic chamber for measuring pressure changes of said hydraulic fluid and for sending a warning signal upon said hydraulic fluid pressure reaching a predetermined level caused by an overload condition on said worm.

9. The load sensing device of claim 8 wherein said hydraulic chamber is defined on one side by a bearing retainer coupled to a main portion of said gear housing and on a second side by a piston disposed around a said worm such that movement of said shaft in a direction transverse to the normal rotational direction of said worm resulting from a load condition on the worm causes like movement of said piston which increases hydraulic pressure in said hydraulic pressure chamber, said pressure increase being sensed by said measuring means.

10. The load sensing device of claim 9 wherein said measuring means comprises a hydraulic pressure gauge.

* * * * *